United States Patent [19]

Iwane et al.

[11] Patent Number: 4,753,544

[45] **Date of Patent: * Jun. 28, 1988**

[54] MULTI-COLOR PLURAL BELT PRINTER WITH SLIDING HAMMER

[75] Inventors: Yasuhiko Iwane, Morioka; Atsushi Iwabuchi, Tamayama; Fukuo Sugawara, Yokohama, all of Japan

[73] Assignee: Alps Electric Co., Ltd., Japan

[ * ] Notice: The portion of the term of this patent subsequent to Jun. 28, 2003 has been disclaimed.

[21] Appl. No.: 800,091

[22] Filed: Nov. 20, 1985

Related U.S. Application Data

[63] Continuation of Ser. No. 530,246, Sep. 8, 1983, abandoned.

[30] Foreign Application Priority Data

Dec. 9, 1982 [JP] Japan ..... 57-216210

[51] Int. Cl.[4] ..... B41J 1/20

[52] U.S. Cl. ..... 400/146; 101/93.14

[58] Field of Search ..... 400/146, 144.2, 145, 400/145.1, 145.2, 152, 151, 150; 101/93.13, 93.14, 93.48, 93.28–93.34

[56] References Cited

U.S. PATENT DOCUMENTS

| | | | |
|---|---|---|---|
| 547,146 | 10/1895 | Hiett | 400/144.2 |
| 1,604,110 | 10/1926 | Aronson | 400/152 X |
| 3,115,092 | 12/1963 | Sasaki | 101/93.14 |
| 3,691,947 | 9/1972 | Berglund et al. | 101/93.14 |
| 4,075,945 | 2/1978 | Bienholz | 101/93.14 |
| 4,192,230 | 3/1980 | Blom et al. | 101/93.29 |
| 4,226,180 | 10/1980 | Matsui | 400/146 X |
| 4,443,123 | 4/1984 | Ono et al. | 101/93.14 |
| 4,455,936 | 6/1984 | Hori | 400/146 |

FOREIGN PATENT DOCUMENTS

| | | | |
|---|---|---|---|
| 2926819 | 1/1980 | Fed. Rep. of Germany | 400/144.2 |
| 161654 | 12/1980 | Japan | 400/146 |
| 29472 | 2/1982 | Japan | 400/146 |
| 100089 | 6/1982 | Japan | 400/152 |
| 144777 | 9/1982 | Japan | 400/146 |
| 142374 | 9/1982 | Japan | 400/146 |
| 182466 | 11/1982 | Japan | 400/146 |

*Primary Examiner*—E. H. Eickholt

*Attorney, Agent, or Firm*—Guy W. Shoup

[57] ABSTRACT

A printer comprises a plurality of type belts each having a variety of types thereon, turning means for driving the type belts, coloring means for applying inks of different colors to the type belts, hammer means for pressing the types against a sheet of print paper, and a shift mechanism for moving the hammer means into positions confronting the type belts, respectively, and for keeping the hammer means in one of the positions at a time.

7 Claims, 3 Drawing Sheets

MULTI-COLOR PLURAL BELT PRINTER WITH SLIDING HAMMER

This is a continuation application from application Ser. No. 530,246 filed Sept. 8, 1983 now abandoned.

BACKGROUND OF THE INVENTION

The present invention relates to a printer, and more particularly to a serial printer.

Electronic desktop calculators recently available are becoming more and more sophisticated functionally and higher in grade, and also smaller in size and more lightweight. There are also demands for small-size and lightweight electronic desktop calculators equipped with printers for recording calculations as printed data. Therefore, the printers contained in such electronic desktop calculators should also be small in size, lightweight, and of a small power requirement. Printers in electronic devices for general home use are preferably of the matrix printing type since such printers can use a roll of plain paper that is readily and inexpensively available and can print data clearly. Such printers are also expected to have a small-size drive source and be less costly.

SUMMARY OF THE INVENTION

It is an object of the present invention to provide a printer which will meet the foregoing requirements.

Another object of the present invention is to provide a printer capable of easily printing data in different colors.

According to the present invention, there is provided a printer comprising a plurality of type belts each having a variety of types thereon, turning means for driving the type belts, coloring means for applying inks of different colors to the type belts, hammer means for pressing the types against a sheet of print paper, and a shift mechanism for moving the hammer means into positions confronting the type belts, respectively, and for keeping the hammer means in one of the positions at a time.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
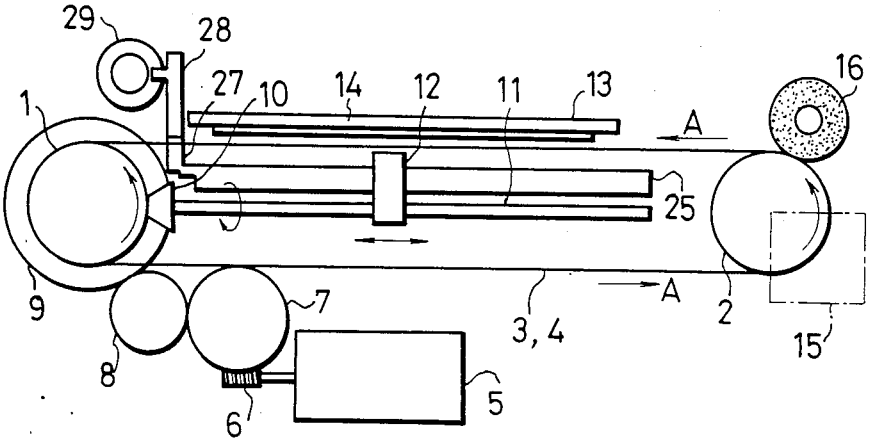
FIG. 1 is a schematic plan view of a printer according to the present invention.

As shown in FIG. 1, a printer according to the present invention comprises a drive pulley 1 and a driven pulley 2 spaced from each other, and a pair of endless type belts 3, 4 are trained around the drive and driven pulleys 1, 2. Drive power from a single motor 5 serving as a drive source is transmitted through a first idle gear 7 and a second idle gear 8 to a main gear 9, from which rotative power flows through a clutch (not shown) to the drive pulley 1. A print and carry gear 10 is held in mesh with the main gear 9.

A shaft 11 has an end coupled to the print and carry gear 10 and is interposed between the drive and driven pulleys 1, 2 in parallel relation to the type belts 3, 4.

The shaft 11 supports a hammer holder 12 axially slidably thereon, the hammer holder 12 holding a hammer and a hammer presser as described later on. A guide plate 13 is disposed outside of the type belts 3, 4. A sheet 14 of print paper is inserted between the guide plate 13 and the type belts 3, 4 and guided and fed by a suitable means (not shown to a position outside of and adjacent to the type belts 3, 4.

A position detector 15 is disposed adjacent to the driven pulley 2. A coloring means 16 in the form of an ink roller is also positioned adjacent to the driven pulley 1 for coating ink on the surfaces of the types formed on the outer peripheral surfaces of the type belts 3, 4, as described later on.

Figure 2:
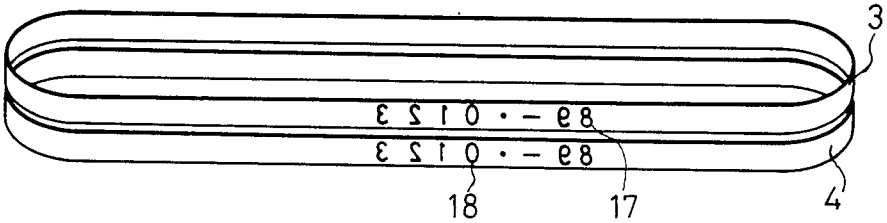
FIG. 2 is perspective view of a type belts thereof.

As illustrated in FIG. 2, the upper type belt 3 has a multiplicity of types 17 formed on the outer peripheral surfaces at predetermined intervals or pitches, the types 17 including numerical characters such as "0", "1", "2" and. the like and other symbols such as "×", "÷", "−", "+", ∓"and the like. Likewise, the lower type belt 4 has a multiplicity of types 18 indentical with the types 17. The type belts 3, 4 are molded of synthetic rubber or synthetic resin of a low degree of polymerization so that the type belts are suitably flexible, extensible and elastic as a whole.

Figure 3:
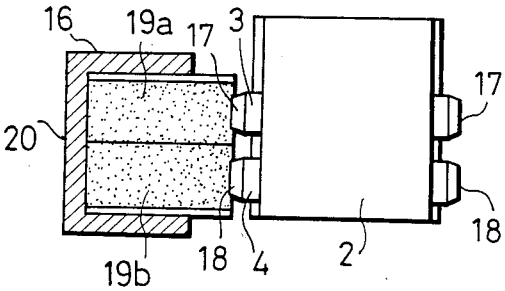
FIG. 3 is a side elevational view, partly in cross section, showing the type belts and an ink roller.

As shown in FIG. 3, the ink roller 16 comprises an upper body 19*a* of sponge impregnated with red ink, a lower body 19*b* of sponge impregnated with black ink, and a cover 20 covering the upper and lower sponge bodies 19*a*, 19*b*. The ink roller 16 is urged toward the type belts 3, 4 so that the upper sponge body 19*a* is held in contact with the types 17 on the upper type belt 3 and the lower sponge body 19*b* is held in contact with the types 18 on the lower type belt 4. Therefore, the types 17 on the upper type belt 3 are always coated with red ink, while the types 18 on the lower type belt 4 are always coated with black ink.

Printing operation of the printer thus constructed will be described.

The controls for the following described printing operation are known, for example, as disclosed in U.S. Pat. No. 4,455,936, and will not be described in detail.

When the motor 5 is rotated under the command of a print start signal, the rotative power from the motor 5 is transmitted through the first idle gear 7, the second idle gear 8, and the main gear 9 to the drive pulley 1 to rotate the type belts 3, 4 in the direction of the arrow A as shown in FIG. 1. It is now assumed that a reference position on the type belts 3, 4 is detected by the position detector 15.

The distance the type belt has traversed from the type (for example, the numeral "0") confronting a hammer 21 at the time the reference position has been detected to the type to be printed. (for example, the numeral "3") is counted, and when the type carrying the numeral "3" faces the hammer 21, the clutch is disconnected to cut off the power flow from the motor 5 to the drive pulley 1. Then, the numeral "3" is printed by the hammer 21.

Figure 4:
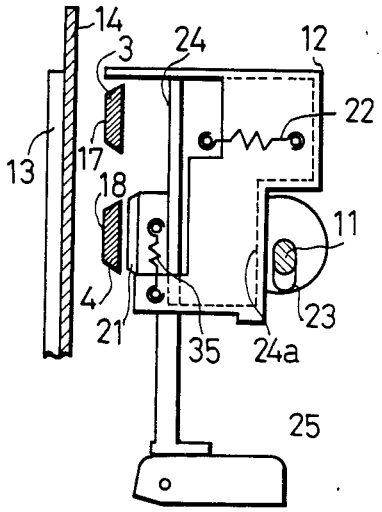
FIGS. 4 and 5 are side elevational views showing printing and hammer shifting operations.
Figure 5:
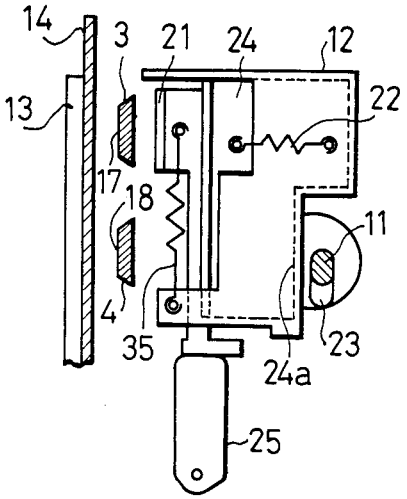

In FIGS. 4 and 5, the hammer 21 which is vertically slidable, is supported on a hammer presser 24 which is retracted rearwardly away from the type belts 3 and 4 by a tension spring 22. The shaft 11 makes one complete revolution in response to rotative power from the main gear 9. During a former half of such revolution of the shaft 11, a hammer driver 23 abuts against a bearing portion 24*a* of the hammer presser 24. Continued rotation of the hammer driver 23 causes the hammer presser 24 to be pushed forward against the resiliency of the tension spring 22.

The selected type carrying the numeral "3" in confronting relation to the sheet 14 of print paper is forced forward by the hammer presser 24 and the hammer 21 into pressing engagement with the sheet 14 to print the desired numeral "3".

During a latter half of the revolution of the shaft 11, a hammer holder carrying operation is effected. When the numeral "0" is next selected to be printed, a type bearing the numeral "0" closest to the previously selected type bearing the numeral "3" in the direction of rotation of the type belts 3, 4 is selected since the movement of the type belts is the smallest. During the type position detection, the distance from the previously selected type bearing the numeral "3" which has faced the hammer 21 to the newly selected type bearing the numeral "0", and the distance the hammer 21 has moved for one character position are added and computed. Based on the results of the computation, the type belts 3, 4 are rotated and the numeral "0" is printed.

The hammer 21 is positioned in confronting relation to either the upper type belt 3 or the lower type belt 4 to print characters selectively in black or red.

A shift mechanism for shifting the hammer 21 will be described.

Figure 6:
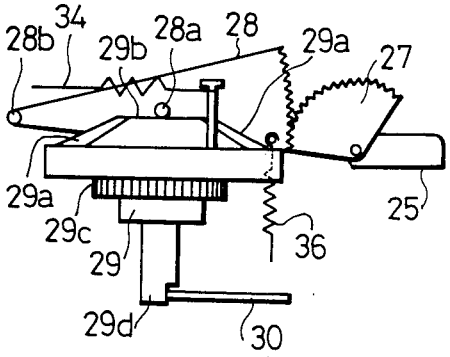
FIGS. 6 and 7 are side elevational views illustrative of a shift mechanism for shifting a hammer upwardly and downwardly.
Figure 7:
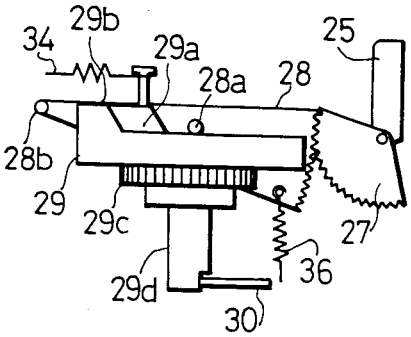

As shown in FIGS. 4 and 5, the hammer 21 is urged downwardly against an eccentric shift cam 25 under the resiliency of a spring 35. The eccentric shift cam 25 extends fully over a region in which the hammer 21 can strike the types. The eccentric shift cam 25 is coupled to a shift lever 27 gear which, as shown in FIGS. 6 and 7, has teeth held in mesh with teeth of a shift lever 28.

Figure 8:
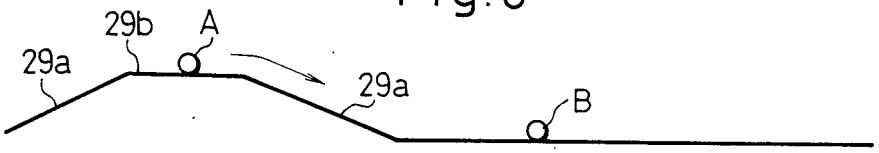
FIG. 8 is a diagram showing a path of movement of a projection for the shift mechanism.
Figure 9:
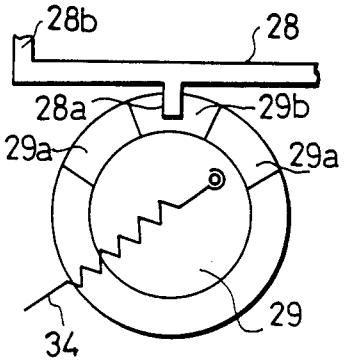
FIGS. 9 and 10 are plan views of the shift mechanism shown in FIGS. 6 and 7.
Figure 10:
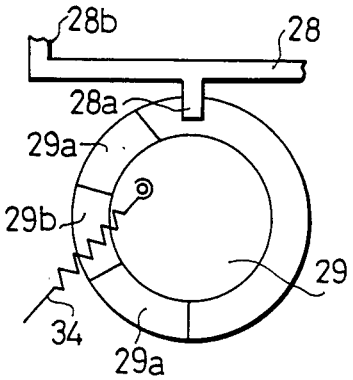

The shift lever 28 and a shift gear 29 are shown as seen from above are shown in FIGS. 9 and 10. The shift lever 28 is pivotably movable about a pivot 28*b* with a projection 28*a* placed on a slide surface of the shift gear 29. As shown in FIG. 8, the slide surface of the shift gear 29 includes slanted surfaces 29*a* and a stepped portion 29*b*. The hammer 21 is shifted vertically as the projection 28*a* of the shift lever 28 slides over the slanted surfaces 29*a* and the stepped portion 29*b*.

Figure 11:
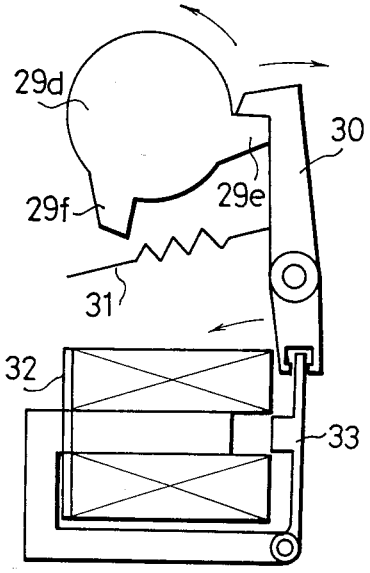
FIGS. 11 and 12 are side elevational views of locking pawls on a clutch gear integral with a shift gear and a solenoid.
Figure 12:
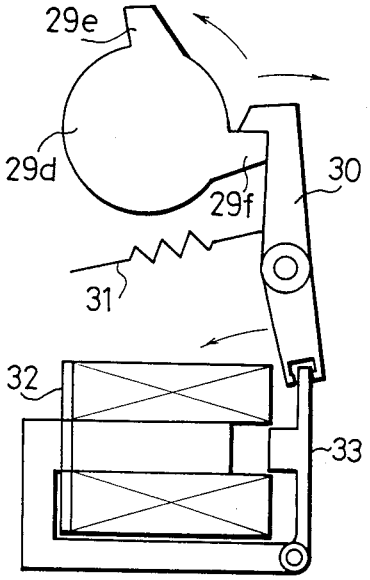

As shown in FIGS. 11 and 12, the shift gear 29 has a clutch gear 29*d* having locking pawls 29*e* and 29*f* angularly spaced from each other. A clutch lever 30 is engageable with one of the locking pawls 29*e*, 29*f* at a time, and is pivotably supported on a shaft, the clutch lever 30 being normally urged by a spring 31 to move toward the clutch gear 29*d*.

The clutch lever 30 has an end held in engagement with an actuator 33 of a solenoid 32. The clutch gear 29*d* has teeth 29*c* held in mesh with the main gear 9 for rotating the clutch gear 29*d*. The teeth 29*c* are, however, kept out of mesh with the main gear 9 when the clutch gear 29*d* is locked by the clutch lever 30 engaging the locking pawls 29*e*, 29*f*. When the solenoid 32 is energized to attract the actuator 33 so that the clutch lever 30 is released from the locking pawls 29*e*, or 29*f*, the main gear 9 and the teeth 29*c* are brought into mesh with each other.

FIGS. 4, 6, 9 and 11 show the position in which the hammer 21 faces the lower type belt 4 and the shift gear 29 is ready for shifting the hammer 21. At this time, the projection 28*a* of the shift lever 28 is located at a position A on the stepped portion 29*a* of the shift gear 29.

After the desired character has been printed in the foregoing printing operation, the solenoid 32 is energized to attract the actuator 33 toward the solenoid 32, thereby causing the clutch lever 30 to turn clockwise until it disengages from the locking pawl 29*e* of the clutch gear 29*d*. The clutch gear 29*d* is then rotated counterclockwise, and so is the shift gear 29 to cause the projection 28*a* of the shift lever 28 to move from the point A to a point B as shown in FIG. 8. When the clutch lever 30 has fully been released from the locking pawl 29*e* on energization of the solenoid 32, the solenoid 32 is de-energized to allow the clutch lever 30 to turn counterclockwise under the force of the spring 31 until the clutch lever 30 locks the locking pawl 29*f*, whereupon the rotation of the shift gear 29 comes to a stop as shown in FIG. 12.

The above operation will be described in relation to the hammer shifting movement. When the clutch lever 30 is released from the locking pawl 29*e* on energization of the solenoid 32, the shift gear 29 starts rotating under the bias of the spring 34. As the projection moves from the point A to the point B shown in FIG. 8, the shift lever 28 is turned clockwise (FIG. 6) about the pivot 28*b*, and the shift lever gear 27 in mesh with the shift lever 28 is turned counterclockwise. The eccentric shift cam 25 directly coupled with the shift lever gear 27 then starts to turn counterclockwise to thereby move the hammer 21 to the position confronting the upper type belt 3 as shown in FIG. 5. At this time, the clutch lever 30 is engaged by the locking pawl 29*f* as shown in FIG. 12, and the projection 28*a* is displaced from the position A to the position B of FIG. 8. The projection 28*a* is then stopped in the position B (seet FIG. 7), whereupon the hammer 21 is held in the upper position. After the foregoing hammer shifting operation, the hammer 21 is actuated to effect printing operation.

If characters are to be printed in black after the data on one line has been printed in black, then the sheet of print paper is fed along for a one-line interval. If characters are to be printed in red, then the sheet of print paper is fed along for a two-line interval. For printing the characters in a different color, the sheet of print paper is fed along on the basis of arithmetic processing to perform desired printing.

Paper feed control mechanisms are well known, for example, as disclosed in U.S. Pat. No. 4,455,936, and are not described further herein.

While in the foregoing embodiment the upper type belt 3 has types 17 coated with red ink and the lower type belt 4 has types 18 coated with black ink, the types 17, 18 may be coated with blank and red inks, respectively, or may be coated with inks of other colors than red and black.

With the arrangement of the present invention, the hammer 21 can be shifted upwardly and downwardly to print characters selectively in different colors with ease.

Although a certain preferred embodiment has been shown and described, it should be understood that many changes and modifications may be made therein without departing from the scope of the appended claims.

What is claimed is:

1. A printer comprising a plurality of type belts each having a variety of types thereon, turning means for driving said type belts, coloring means for applying inks of different colors to said type belts, hammer means for pressing said types against a sheet of print paper, and a shift mechanism for moving said hammer means into positions confronting said type belts, respectively, and for keeping said hammer means in one of said positions at a time;

wherein said shift mechanism comprises an eccentric shift cam for moving said hammer means into said positions against a resilient force, a shift lever for turning said eccentric shift cam, said shift lever having a projection, a shift gear having a slide surface of which said projection is slidably placed, said slide surface having a stepped portion and a pair of slanted surfaces extending from opposite edges of said stepped portion for allowing said shift lever to move into different positions, said shift gear being lockable when said shift lever is moved into said last-mentioned positions.

2. A printer for printing lines on a recording paper from different type belts comprising:

a driving pulley, and a driven pulley spaced a given distance from the driving pulley;

a plurality of endless type belts disposed at different vertical positions and trained around the driving and driven pulleys so as to be parallel to the lines to be printed on the recording paper, each of the belts having type elements supported on the outer periphery thereof which are selectively movable to a printing position for printing on the recording paper;

rotating means for rotating the driving pulley for laterally shifting the type belts;

detecting means for detecting a reference position established on the type belts;

storage means for storing the distance of each type element on the type belts from the reference position, the distance being expressed as the number of type elements existing between a selected type element and the reference position;

counter means for counting the number of type elements moved from the reference position in synchronism with the rotation of the driving pulley to shift the type belts so as to bring a selected type element on one of the type belts to the printing position;

a shaft extending parallel to the type belts;

hammer means mounted to the shaft so as to be slidable axially thereon to successive printing positions, said hammer means being actuated at a printing position to press a selected type element on one of the type belts against the recoridng paper; and a shift mechanism for vertically moving the hammer means to a vertical position where it faces a selected one of the type belts to print a selected type element therefrom and for holding the hammer means at said vertical position.

3. A printer according to claim 2, wherein said type belts are flexible, extensible and elastic as a whole.

4. A printer according to claim 2, wherein said hammer means comprises a hammer slidably movable to said vertical positions and a hammer presser for pressing said hammer against said type belts respectively in said vertical positions.

5. A printer according to claim 2, wherein said hammer presser is normally urged under a resilient force in a direction away from said type belts, said hammer means further including a hammer driver for pushing said hammer presser against said resilient force.

6. A printer according to claim 1, further comprising a plurality of ink coloring means each associated with a respective one of said type belts for providing a respective ink color to type elements printed from the associated type belt, whereby said printer is adapted to print lines of different color on the recording paper.

7. A printer according to claim 6, wherein said coloring means comprises a cylindrical roller having an outer peripheral surface for coating surfaces of said type on said type belts with the inks.

* * * * *